US009028586B2

(12) United States Patent
Kempf et al.

(10) Patent No.: US 9,028,586 B2
(45) Date of Patent: May 12, 2015

(54) OXIDATION METHOD

(75) Inventors: Bernd Kempf, Kleinwallstadt (DE); Gunther Wiehl, Jena (DE); Werner Roth, Hasselroth (DE); Andreas Koch, Hanau (DE); Peter Braumann, Alzenau (DE); Ralf Niederreuther, Obertshausen (DE)

(73) Assignee: Umicore, Brussels (BE)

( * ) Notice: Subject to any disclaimer, the term of this patent is extended or adjusted under 35 U.S.C. 154(b) by 0 days.

(21) Appl. No.: 13/339,723

(22) Filed: Dec. 29, 2011

(65) Prior Publication Data

US 2013/0167689 A1 Jul. 4, 2013

(51) Int. Cl.

| | |
|---|---|
| ***C22C 5/06*** | (2006.01) |
| ***H01H 1/02*** | (2006.01) |
| ***C22C 1/10*** | (2006.01) |

(52) U.S. Cl.

CPC ..... *C22C 1/1078* (2013.01); *C22C 5/06* (2013.01)

(58) Field of Classification Search

CPC ..... C22C 1/1078; C22C 5/06; H01H 1/0237; H01H 1/023

USPC ..... 75/585

See application file for complete search history.

(56) References Cited

U.S. PATENT DOCUMENTS

| | | | | |
|---|---|---|---|---|
| 3,778,257 | A | 12/1973 | Davies | |
| 3,933,485 | A | 1/1976 | Shibata | |
| 3,970,451 | A | 7/1976 | Davies | |
| 4,217,139 | A | 8/1980 | Kim et al. | |
| 4,243,413 | A | 1/1981 | Shibata | |
| 4,457,787 | A | 7/1984 | Shibata | |
| 4,472,211 | A | 9/1984 | Shibata | |
| 4,609,525 | A * | 9/1986 | Schreiner et al. | 419/6 |
| 4,846,901 | A * | 7/1989 | Lima et al. | 148/678 |
| 5,207,842 | A | 5/1993 | Guerlet et al. | |
| 5,486,919 | A | 1/1996 | Tsuji et al. | |
| 5,607,522 | A * | 3/1997 | McDonnell | 148/281 |
| 2005/0028896 | A1 * | 2/2005 | Uemura et al. | 148/431 |
| 2008/0128054 | A1 | 6/2008 | Johns | |

FOREIGN PATENT DOCUMENTS

| | | |
|---|---|---|
| DE | 000003333282 | 3/1984 |
| EP | 508055 | 10/1992 |
| FR | 2274999 | 1/1976 |
| GB | 1469976 | 4/1977 |
| GB | 1524074 | 9/1978 |
| GB | 2127040 | 4/1984 |
| JP | 06317534 | 11/1994 |
| JP | 6349369 | 12/1994 |
| JP | 8153441 | 6/1996 |
| JP | 2011246791 A * | 12/2011 |

OTHER PUBLICATIONS

Machine translation of JP 2011246791 A. Dec. 2011.*

International Search Report, issued in co-assigned PCT/EP2010/069786, dated May 23, 2011.

Sakairi et al., "Manufacturing Process and Characteristics of AgSmO2 for Electrical Contact Materials," Holm Conferences on Electrical Contacts, (1982), pp. 77-85.

* cited by examiner

*Primary Examiner* — Jie Yang
*Assistant Examiner* — Xiaowei Su
(74) *Attorney, Agent, or Firm* — Brinks Gilson & Lione

(57) ABSTRACT

The present invention relates to a novel process for producing metal composites by internal oxidation.

13 Claims, No Drawings

OXIDATION METHOD

FIELD OF THE INVENTION

The present invention relates to a novel process for producing metal composites by internal oxidation.

BACKGROUND

Metal composites have been known for a long time and are employed in numerous fields. They include, for example, oxide-dispersed metals such as refractory metals provided with yttrium oxide for fine grain stabilization. In other fields, materials of this type based on silver have become established, particularly in the field of contact materials.

U.S. Pat. No. 5,207,842 describes silver-based materials which have been obtained by mixing of silver metal powder with powder composed of tin oxide and tellurium oxide and subsequent pressing and sintering. Materials of this type based on silver and tin oxide are well suited as contact materials.

In Holm Conferences on Electrical Contacts 1982, pages 77-85, Sakairi et al. describe a process for the internal oxidation of silver alloys. For the purposes of the present invention, internal oxidation is a process in which an alloy of silver with lesser noble metals is subjected to oxidizing conditions, which brings about oxidation of the less noble metals but not of silver. Silver-tin oxide materials containing finely divided tin oxide in amounts of from 9.3% by weight to 11.7% by weight and silver-cadmium oxide materials containing finely divided cadmium oxide in amounts of 12.4% by weight were obtained in this way. The materials had to be heat treated in order to make them processable. The internal oxidation was carried out for one week at 450° C. in a pure oxygen atmosphere at a gauge pressure of 9 atmospheres.

U.S. Pat. No. 4,243,413 discloses a silver-tin oxide contact material which contains oxides of tin, nickel and indium. The internal oxidation was carried out for 40 hours at 700° C. under a gauge pressure of 10 atm.

EP-A-508055 discloses silver-based contact materials which can be obtained by internal oxidation of alloys composed of 4-11% by weight of tin, 1-5% by weight of indium, from 0.05 to 4% by weight of tellurium and optionally 0.01-1% by weight of iron, nickel or cobalt and/or from 0.05 to 3% by weight of cadmium, balance silver. The internal oxidation is carried out in an oxidizing atmosphere at from 650° C. to 750° C. for from 8 to 26 hours.

All production processes by means of internal oxidation which have been described are carried out under superatmospheric pressure for a comparatively long time. It would therefore be desirable to make production at a relatively low pressure, for example atmospheric pressure (i.e. without employing superatmospheric pressure), possible. The present invention relates to providing a process for producing silver-based contact materials at a relatively low pressure without significantly impairing the advantageous properties of the materials.

SUMMARY OF THE INVENTION

In an aspect of the invention, a process for producing materials based on silver comprises providing a first alloy containing silver and at least one oxidizable alloying element; enlarging the surface area of the first alloy containing silver and the at least one oxidizable alloying element to give a second alloy; performing a first heat treatment of the second alloy, with the first heat treatment being carried out in a reducing atmosphere, to give a third alloy; and performing a second heat treatment of the third alloy, with the second heat treatment being carried out in an oxygen-containing atmosphere, to give a fourth alloy.

In another aspect of the invention, a process for producing cadmium-free materials based on silver comprises providing a first alloy which is free from cadmium and contains silver and at least one oxidizable alloying element; enlarging the surface area of the first alloy containing silver and the at least one oxidizable alloying element to give a second alloy; performing a first heat treatment of the second alloy, with the heat treatment being carried out in a reducing atmosphere to give a third alloy; and performing a second heat treatment of the third alloy, with the heat treatment being carried out in an oxygen-containing atmosphere to give a fourth alloy.

In a feature of the invention, the first heat treatment is carried out at a temperature of from 350° C. to 5° C. below the solidus temperature of the first alloy. For example, the first heat treatment may be carried out at 650° C.

In a feature of the invention, the first heat treatment is carried out for a time of from 15 seconds to 3 hours. In another feature of the invention, the first heat treatment is carried out in a reducing atmosphere containing hydrogen, carbon monoxide, hydrocarbons, methane, nitrogen, a noble gas or mixtures thereof. In yet another feature of the invention, the first heat treatment is carried out in a stream of a reducing atmosphere at a pressure of less than 2 bar.

In still another feature of the invention, the third alloy is cooled in an inert or reducing atmosphere to a temperature of less than 200° C. after the first treatment. For example, it may be cooled to room temperature room temperature. In an additional feature of the invention, the second heat treatment is carried out at a temperature of from 500° C. to a temperature which is 150° C. below the solidus temperature of the first alloy. For example, it may be carried out at a temperature that is 5° C. below the solidus temperature of the first alloy.

In another feature of the invention, the second heat treatment is carried out in two temperature stages, where the first stage is carried out at a first temperature of from 500° C. to 150° C. below the solidus temperature of the first alloy for a first period of time and the second stage is carried out at a temperature of from 500° C. to 5° C. below the solidus temperature of the first alloy for a second period of time, with the second temperature being higher than the first temperature.

In yet another feature of the invention, the first period of time is from 30 to 240 minutes and the second period of time is from 10 hours to 7 days. In an additional feature of the invention, the second heat treatment is carried out in an oxygen-containing atmosphere containing elemental oxygen, nascent oxygen, ozone, nitrogen, noble gas or mixtures thereof. In a further feature, the second heat treatment is carried out in a stream of an oxygen-containing atmosphere under a pressure of less than 2 bar. In yet a further feature, the enlargement of the surface area of the first alloy is affected by milling, gas atomization, liquid atomization, granulation, wire drawing, rolling of metal sheets, extrusion pressing, cutting, extrusion or extrusion pressing or combinations thereof.

In another feature, the second alloy is coated with silver before the heat treatment. In yet another feature, the second alloy has a specific surface area of from 0.75 to 100 $cm^2/g$ determined by the BET method. In an additional feature, the oxidizable alloying element of the first alloy is selected from the group consisting of indium, tellurium, bismuth, nickel, copper, zinc, tin, gallium, germanium, selenium, manganese, magnesium, aluminum, lead and combinations thereof. In a further feature, the first alloy contains up to 8% by weight of tin.

In still a further feature, the first alloy contains indium and from 8% by weight to 12% by weight of tin. In another feature, the first alloy contains from 2% by weight to 15% by weight of indium. In yet another feature, the first alloy contains from 0.05% by weight to 4% by weight of tellurium. In an additional feature, the first alloy contains iron, nickel, cobalt or copper, either individually or in combination with one another in amounts of in each case from 0.001% by weight to 1% by weight.

In yet another feature, the first alloy contains zinc instead of tin. In another feature, the first alloy contains bismuth instead of tellurium. In another feature, the fourth alloy contains at least one oxide selected from the group consisting of tin oxide, indium oxide, tellurium oxide, bismuth oxide, nickel oxide, copper oxide, zinc oxide, gallium oxide, germanium oxide, selenium dioxide, manganese dioxide, magnesium oxide, aluminum oxide; lead oxide and mixtures thereof.

In an additional feature, the fourth alloy contains more than 12% by weight of oxide. In a further feature, the fourth alloy cools after the second heat treatment. In another feature, the fourth alloy is subjected to a third heat treatment to give a fifth alloy. In yet another feature, the third heat treatment is carried out at from 900 to 970° C. for from 2 to 40 hours. For example, the third treatment may be carried out from 10 to 20 hours. In another feature, the fourth or fifth alloy is pressed, sintered and optionally formed by extrusion pressing.

DETAILED DESCRIPTION OF THE INVENTION

The inventive process enables production of silver-based contact materials at a relatively low pressure without significantly impairing the advantageous properties of the materials. The process comprises providing a first alloy containing silver and at least one oxidizable alloying element; enlarging the surface area of the first alloy containing silver and the at least one oxidizable alloying element to give a second alloy; performing a first heat treatment of the second alloy, with the first heat treatment being carried out in a reducing atmosphere, to give a third alloy; and performing a second heat treatment of the third alloy, with the second heat treatment being carried out in an oxygen-containing atmosphere, to give a fourth alloy.

It has surprisingly been found that enlargement of the surface area and subsequent heat treatment in a reducing atmosphere ensures sufficient activation to allow internal oxidation, which takes place during the second heat treatment at less than 2 bar pressure, in particular at atmospheric pressure, over a period of from about 10 hours to 7 days, to occur. The duration depends on factors such as alloy composition, oxygen partial pressure, atmosphere used, the surface area and the temperature.

The oxidizable alloying element of the first alloy is selected from the group consisting of indium, tellurium, bismuth, nickel, copper, zinc, tin, gallium, germanium, selenium, manganese, magnesium, aluminum, antimony, lead and combinations thereof. In an exemplary embodiment, the total amount of oxidizable alloying elements is generally from 5% by weight to 15% by weight.

In another exemplary embodiment, tin may be used in amounts of from 5% by weight to 15% by weight. For example, tin may be used in an amount of at least 8% by weight of tin, as oxidizable alloying element, so that tin oxide contents of from 5% by weight to 18% by weight, in particular tin oxide contents of from 8 to 14% by weight, are obtained after the internal oxidation. In the case of tin contents above 7% by weight, in particular above 8% by weight or 9% by weight, up to 5% by weight of indium may be added. Zinc and tin are sufficiently similar for tin to be replaced wholly or partially by zinc in the present invention. In this case, when zinc is used instead of tin, the addition of indium is often unnecessary.

Use of alloys of silver and tin or silver and zinc give contact materials which are suitable for many purposes, even at tin or zinc contents of from 6.7% by weight to 8.5% by weight.

The indium content can be from 2% by weight to 15% by weight. For example, the indium content may be from 1% by weight to 5% by weight or from 1.5% by weight to 3% by weight. In addition, tellurium may be added in amounts of from 0.05% by weight to 4% by weight, or from 0.05% by weight to 0.8% by weight or from 0.1% by weight to 1% by weight. Instead of tellurium, it is in principle also possible to use bismuth in the same amounts. For example, tellurium may be added in amounts of from 0.005% by weight to 0.06% by weight.

Further elements which can optionally be added are iron, nickel, cobalt or copper, either individually or in combination with one another. Each of these elements can be used in amounts of from 0.001% by weight to 1% by weight, for example, from 0.05 to 0.2% by weight or from 0.03 to 0.5% by weight. Particular preference is given to nickel and copper. Particular preference is given to adding from 0.03% by weight to 0.5% by weight of nickel or from 0.05% by weight to 0.9% by weight of copper.

These elements (iron, nickel, cobalt, and copper) are together present in amounts of usually less than 1.5% by weight.

In an exemplary embodiment, the first alloy is an alloy composed of 4-11% by weight of tin, 1-6% by weight of indium, from 0.05 to 4% by weight of tellurium and optionally 0.01-1% by weight of iron, nickel, cobalt or combinations thereof, balance to 100% by weight silver and unavoidable impurities. Owing to its toxicity, cadmium is no longer used and therefore not employed.

Suitable first alloys are silver alloys composed of from 5.1 to 9% by weight of tin, from 1.5 to 5% by weight of indium, from 0.05 to 0.8% by weight of tellurium, optionally together with from 0.03 to 0.5% by weight of nickel, from 0.05 to 0.9% by weight of copper and balance to 100% by weight silver and unavoidable impurities. As an alternative, from 0.005 to 0.06% by weight of bismuth can be used instead of tellurium.

Further alloys suitable as first alloy are alloys containing from 5% by weight to 8% by weight of tin, from 1.5% by weight to 3% by weight of indium, from 0.1% by weight to 1% by weight of tellurium, from 0.05% by weight to 0.2% by weight of iron and balance to 100% by weight silver and unavoidable impurities.

Additional suitable first alloys are silver alloys composed of from 5.1 to 9% by weight of tin, from 1.5 to 5% by weight of indium, from 0.05 to 0.8% by weight of tellurium, optionally together with from 0.03 to 0.5% by weight of nickel, from 0.05 to 0.9% by weight of copper and balance to 100% by weight silver and unavoidable impurities. As an alternative, from 0.005 to 0.06% by weight of bismuth can be used instead of tellurium.

Further alloys suitable as first alloy are alloys containing from 5% by weight to 8% by weight of tin, from 1.5% by weight to 3% by weight of indium, from 0.1% by weight to 1% by weight of tellurium, from 0.05% by weight to 0.2% by weight of iron and balance to 100% by weight silver and unavoidable impurities; or from 5% by weight to 8% by weight of tin, from 1.5% by weight to 3% by weight of indium, from 0.1% by weight to 1% by weight of tellurium, from 0.05% by weight to 0.2% by weight of cobalt and balance to 100% by weight silver and unavoidable impurities; or from 5.2% by weight to 8% by weight of tin, from 2.8% by weight to 3.9% by weight of indium, from 0.5% by weight to 0.75% by weight of tellurium, from 0.08% by weight to 1.2% by weight of nickel and balance to 100% by weight silver and unavoidable impurities; or from 5.2% by weight to 8% by weight of tin, from 2.8% by weight to 3.9% by weight of indium, from 0.5% by weight to 0.75% by weight of tellurium, from 0.05% by weight to 0.9% by weight of copper and balance to 100% by weight silver and unavoidable impurities; or from 5% by weight to 8% by weight of tin, from 1.5% by weight to 3% by weight of indium, from 0.1% by weight to 1% by weight of tellurium, from 0.05% by weight to 0.9% by weight of copper and balance to 100% by weight silver and unavoidable impurities.

The enlargement of the surface area of the first alloy can be caused by milling, gas atomization, liquid atomization, granulation, wire drawing, rolling of metal sheets, extrusion pressing, cutting, extrusion, extrusion pressing and combinations thereof. For example, the first alloy can be extrusion pressed to form wire or a sheet metal profile and subsequently be cut up, or metal sheets or plates can be rolled and subsequently cut into strips. Here, it is firstly important to enlarge the surface area, but also to reduce the thickness, through which oxygen has to penetrate from the outside, of the metal particles which are to be subjected to the internal oxidation in the second heat treatment. In a specific embodiment of the invention, the second alloy has a specific surface area of from 0.75 to 100 $cm^2/g$ determined by the BET method.

In a further specific embodiment of the invention, the second alloy can be coated with silver. Here, a metal profile can, for example, be extrusion pressed, coated with silver in a manner known per se (for example clad) and then be subjected further to the process of the invention, so that a contact workpiece which is suitable either as a semifinished part or even as an end product for direct use in a switching device is obtained directly by the process of the invention.

The first heat treatment is carried out under reduced conditions at a temperature of at least 350° C. The upper limit to the temperature for this process step is 5° C. below the solidus temperature of the first or second alloy. In general, a temperature range from about 550° C. to 700° C., in particular from 630° C. to 670° C., for example 650° C., is suitable. This first heat treatment is carried out for a time of from 15 seconds to 3 hours, in particular from 30 minutes to 90 minutes. A longer heat treatment does no harm but usually results in no further advantages. The heat treatment of the second alloy is carried out under a reducing atmosphere. Suitable reducing atmospheres are, for example, hydrogen, carbon monoxide, hydrocarbons, methane, nitrogen, noble gas or mixtures thereof. For example, hydrogen or a mixture of hydrogen may be used with an inert gas such as nitrogen or a noble gas. It is inexpensive to use forming gas, which is commercially available as a mixture of hydrogen and nitrogen, usually with a hydrogen content of from 5% to 25%, in particular from 5% to 10%. The pressure in the first heat treatment is less than 2 bar, for example, the treatment may be carried out at atmospheric pressure. It is usually simplest to employ a procedure in which the second alloy is heat treated in a stream of the reducing atmosphere, e.g. forming gas, at atmospheric pressure. This process step gives the third alloy which, after the first heat treatment, may be cooled in an inert or reducing atmosphere to a temperature of less than 200° C., for example, room temperature.

The second heat treatment is then carried out; this can be carried out directly afterwards. The third alloy does not have to be processed further directly and can also be handled or stored in air for a limited time and subjected to this process step at a later point in time. However, quick further processing, in particular directly after the first heat treatment, is also possible. Thus, for example, the first heat treatment can, in a batch process, be carried out in a retort, with the reducing atmosphere being replaced after cooling by an oxidizing atmosphere and the second heat treatment being carried out in such a way that no contact with air takes place. As an alternative, the first heat treatment can be carried out in a pusher furnace having a temperature gradient. Here, the material being reacted is usually, for example, pushed through the furnace in a graphite crucible. After going through the pusher furnace in a reducing atmosphere, the crucible can be taken out after cooling to 200° C. or below and, after a short time in air, go through a second pusher furnace having an oxidizing atmosphere to carry out the second heat treatment. In this procedure, a more or less long contact with air takes place.

In this second heat treatment, the internal oxidation of the third alloy in an oxidizing atmosphere takes place and the fourth alloy is obtained. This internal oxidation brings about transformation of an alloy into a composite of silver and the oxides of the oxidizable alloying elements (here referred to as fourth alloy). The second heat treatment is carried out at a temperature of at least about 500° C. The treatment should be carried out at not more than 150° C. below the solidus temperature, for example, at up to 5° C. below the solidus temperature, of the first, second or third alloy. These temperatures do not differ significantly since the first, second and third alloys are similar chemically. In general, the second heat treatment is carried out at temperatures of from about 500° C. to about 800° C., for example, from 600° C. to 750° C. or from 650° C. to 730° C. The heat treatment is continued until the internal oxidation is complete. The duration of the second heat treatment is from about 10 hours to about 7 days, for example, from 12 to 72 hours, from 12 to 48 hours, or for 24 hours. However, the duration can also be calculated according to the choice of process parameters and the alloy composition or monitored during the course of the reaction. The reaction can readily be monitored gravimetrically. The end of the reaction can be determined in the finished product (intermediate) by preparing a polished section and examining it under an optical microscope.

The second heat treatment can in principle be carried out in all furnaces which can be used at the temperatures, under the atmospheres and for the times. The third alloy can for this purpose be subjected to the conditions of the second heat treatment in various containers; for example, the third alloy can be subjected to the second heat treatment as a bed of powder or granules, pieces of wire or metal sheet in an open crucible, ceramic crucible or metal container, forming a porous, loose sintered body or shaped body. However, particularly in the case of pieces of metal sheet or wire, separation can be effected in a reaction vessel or else the heat treatment can be carried out in a rotary tube furnace. In this way, the contact with the oxidizing atmosphere is optimized and rapid and complete internal oxidation is aided.

The second heat treatment is carried out in an oxidizing atmosphere, for example, an oxygen-containing atmosphere containing elemental oxygen ($O_2$), nascent oxygen, ozone, nitrogen, noble gas or mixtures thereof. In an example, oxygen or air may be used. The second heat treatment is carried out at a pressure of less than 2 bar and more than 0.5 bar, for example, at a pressure of from about 0.5 bar to about 1.5 bar or at approximately atmospheric pressure or ambient pressure, i.e. generally at about 1 bar. It is often simplest to carry out the second heat treatment in a stream of the oxygen-containing atmosphere (i.e. air or oxygen) at approximately atmospheric pressure, e.g. ambient pressure. Here, the partial pressure of oxygen is at least 80% of the total pressure, for example, virtually 100%.

The second heat treatment may be carried out in two temperature stages, with these being carried out at a first temperature in the range from at least 500° C. to a maximum of 150° C. below the solidus temperature of the first alloy for a first period of time and at a second temperature of from 500° C. to 40° C. below the solidus temperature, but up to a maximum of 5° C. below the solidus temperature, of the first alloy for a second period of time.

In this process variant, too, the treatment is carried out at a pressure of less than 2 bar, for example, at approximately atmospheric pressure and in a stream of the oxygen-containing atmosphere (i.e. air or oxygen) at approximately atmospheric pressure, e.g. under ambient pressure. Here, the partial pressure of oxygen is likewise at least 80% of the total pressure.

The second temperature is higher than the first temperature and is from about 500° C. to about 800° C., for example, from 600° C. to 750° C. or from 650° C. to 730° C. In this case, the first period of time is from 30 to 240 minutes and the second period of time is from 10 hours to 7 days, for example, from 12 to 72 hours, in particular from 12 to 48 hours, for example 24 hours. As indicated above, the period of time required can be calculated or else the course of the reaction can be monitored by measurement, for example gravimetry, until the reaction is complete. For example, the internal oxidation when using a wire having a thickness of 2.1 mm is complete after about 100 hours, in the case of a wire having a thickness of 1.4 mm, after only 60 hours, when a material having a total oxide content of 14% by weight is used as starting material. At a total oxide content of 10% by weight, the reaction time required is about 30% shorter.

The second heat treatment results in the fourth alloy. The fourth alloy contains at least one oxide selected from the group consisting of tin oxide, indium oxide, tellurium oxide, bismuth oxide, nickel oxide, copper oxide, zinc oxide, gallium oxide, germanium oxide, selenium dioxide, manganese dioxide, magnesium oxide, aluminum oxide, lead oxide and mixtures thereof.

These oxides have been formed from the alloying constituents of the third alloy during the course of the second heat treatment during which the internal oxidation took place. In a further embodiment of the invention, the fourth alloy contains more than 12% by weight of oxide. The fourth alloy is cooled after the second heat treatment, usually to a temperature of less than 200° C. or to room temperature.

Since the fourth alloy is often very hard because of the finely divided oxides and is difficult to process further, the fourth alloy may be subjected to a third heat treatment to give a fifth alloy. The third heat treatment is carried out at from 900° C. to 970° C. or from 910° C. to 960° C. The third heat treatment is carried out for from 2 to 40 hours, for example, from 10 to 20 hours. This results in Ostwald ripening of the finely divided oxides, which increases conductivity and ductility so as to improve the processability considerably.

Depending on the processability of the fourth alloy without a third heat treatment, the fourth or fifth alloy can be processed further to produce contact workpieces. For this purpose, the fourth or if appropriate the fifth alloy is extrusion pressed and shaped further by cladding rolling or wire drawing, depending on the shape of the desired contact workpieces.

EXAMPLES

The silver alloys shown in the table are melted in an induction furnace and cast to produce bars. The contents of oxidizable alloying elements indicated are in % by weight; the silver content is the balance to 100% by weight. These bars are extrusion pressed to produce wires having an average diameter of about 2 mm and cut into pieces having a length of about 7 mm. These pieces of wire were subsequently subjected to a first heat treatment (1st HT) in a stream of forming gas having a hydrogen content of 5% at atmospheric pressure in a box furnace for the times (t) and the temperatures (T) indicated in the table, the furnace was then switched off and cooling to less than 200° C. was allowed to occur under flowing forming gas, the material was then reheated in flowing, pure oxygen and subjected to the second heat treatment (2nd HT) for the times (t) and at the temperatures (T) indicated in the table. The material was subsequently subjected, if appropriate, to a third heat treatment in air (3rd HT) for the times (t) and at the temperatures (T) indicated in the table. Times are reported in hours, temperatures in degrees Celsius. After cooling, the product was extrusion pressed to give an approximately 6 mm thick wire and processed further by wire drawing to a final diameter of 1-2 mm. All alloys displayed complete conversion of the oxidizable alloying elements under the reaction conditions indicated; this was confirmed by examination of polished sections under an optical microscope.

| | | | | | | | | | 1st HT | | 2nd HT stage 1 | | 2nd HT stage 2 | | 3rd HT | |
|---|---|---|---|---|---|---|---|---|---|---|---|---|---|---|---|---|
| No. | Sn | Zn | In | Te | Ni | Fe | Co | Cu | t | T | t | T | t | T | t | T |
| 1 | 6.5 | | 3.9 | 0.6 | 0.1 | | | | 1 | 660 | 2 | 650 | 100 | 730 | 24 | 920 |
| 2 | 5.2 | | 2.8 | | 0.1 | | | | 1 | 660 | 2 | 650 | 80 | 750 | 24 | 920 |
| 3 | 6.5 | | 3.9 | 0.6 | | 0.1 | | | 1 | 660 | 2 | 650 | 100 | 730 | 24 | 920 |
| 4 | 5.2 | | 2.8 | | | 0.1 | | | 1 | 660 | 2 | 650 | 80 | 750 | 24 | 920 |
| 5 | 6.5 | | 3.9 | 0.6 | | | 0.1 | | 1 | 660 | 2 | 650 | 100 | 730 | 24 | 920 |
| 6 | 5.2 | | 2.8 | | | | 0.1 | | 1 | 660 | 2 | 650 | 80 | 750 | 24 | 920 |
| 7 | 6.5 | | 3.9 | 0.6 | | | | 0.1 | 1 | 660 | 2 | 650 | 100 | 730 | 24 | 920 |
| 8 | 5.2 | | 2.8 | | | | | 0.1 | 1 | 660 | 2 | 650 | 80 | 750 | 24 | 920 |
| 9 | 7.5 | | | | | | | | 1 | 600 | 3 | 620 | 60 | 780 | 24 | 950 |
| 10 | 7.5 | | | | | | | | 1 | 600 | 2 | 680 | 60 | 780 | | |
| 11 | | 8.2 | | | | | | | 1 | 660 | 2 | 650 | 90 | 730 | | |
| 12 | | 8.2 | | | | | | | 2 | 660 | 2 | 650 | 90 | 730 | 24 | 920 |
| 15 | 5.1 | | 3.1 | 0.4 | | | | 0.3 | 2 | 640 | 3 | 680 | 80 | 750 | | |

-continued

| | | | | | | | | | 1st HT | | 2nd HT stage 1 | | 2nd HT stage 2 | | 3rd HT | |
|---|---|---|---|---|---|---|---|---|---|---|---|---|---|---|---|---|
| No. | Sn | Zn | In | Te | Ni | Fe | Co | Cu | t | T | t | T | t | T | t | T |
| 16 | 6.0 | | 3.1 | 0.4 | | | | 0.2 | 2 | 640 | 3 | 660 | 90 | 740 | | |
| 17 | 6.9 | | 3.1 | 0.4 | | | | 0.3 | 2 | 640 | 3 | 620 | 120 | 720 | | |
| 18 | 8.0 | | 3.0 | 0.4 | | | | 0.3 | 2 | 640 | 3 | 620 | 150 | 700 | 12 | 930 |
| 19 | 7.0 | | 1.5 | 0.4 | | | | 0.2 | 2 | 640 | 3 | 680 | 80 | 750 | 12 | 930 |
| 20 | 7.0 | | 5.0 | 0.4 | | | | 0.3 | 2 | 640 | 3 | 600 | 160 | 700 | | |
| 21 | 7.0 | | 3.1 | 0.4 | | | | 0.2 | 1 | 660 | 2 | 650 | 90 | 730 | 24 | 910 |
| 22 | 7.0 | | 3.1 | 0.4 | 0.04 | | | 0.3 | 1 | 660 | 2 | 650 | 90 | 730 | 24 | 910 |
| 23 | 7.0 | | 3.1 | 0.4 | 0.3 | | | 0.3 | 1 | 600 | 3 | 640 | 90 | 730 | 24 | 910 |
| 24 | 7.1 | | 3.0 | 0.4 | 0.4 | | | 0.3 | 1 | 600 | 3 | 640 | 90 | 730 | 24 | 920 |
| 25 | 7.1 | | 3.0 | 0.4 | 0.5 | | | 0.3 | 1 | 660 | 3 | 640 | 90 | 730 | 24 | 920 |
| 26 | 7.0 | | 3.1 | 0.4 | | 0.3 | | 0.3 | 1 | 660 | 3 | 640 | 90 | 730 | 24 | 920 |
| 27 | 7.0 | | 3.1 | 0.4 | | | 0.4 | 0.3 | 1 | 660 | 3 | 640 | 90 | 730 | 24 | 920 |
| 30 | 4.1 | | 2.0 | 0.3 | | | | | 1 | 660 | 2 | 640 | 60 | 750 | 24 | 920 |
| 31 | 7.0 | | 2.1 | 0.3 | | | | | 1 | 600 | 2 | 640 | 60 | 750 | 24 | 920 |
| 32 | 10.8 | | 1.9 | 0.3 | | | | | 1 | 660 | 3 | 630 | 180 | 690 | 24 | 920 |
| 33 | 6.9 | | 2.2 | 0.3 | | 0.9 | | | 1 | 660 | 2 | 650 | 80 | 740 | 24 | 920 |
| 34 | 6.8 | | 1.9 | 0.3 | 0.3 | | | | 1 | 660 | 2 | 660 | 60 | 750 | | |
| 35 | 7.1 | | 2.0 | 0.3 | 0.16 | 0.25 | | | 1 | 660 | 2 | 650 | 80 | 740 | | |
| 36 | 7.0 | | 2.1 | 0.3 | 0.04 | | 0.24 | | 1 | 660 | 2 | 650 | 80 | 740 | | |
| 37 | 7.0 | | 2.1 | 0.3 | 0.12 | 0.11 | 0.10 | | 2 | 650 | 2 | 650 | 80 | 740 | 24 | 920 |
| 38 | 7.2 | | 2.0 | | | 0.5 | | | 2 | 650 | 2 | 660 | 70 | 740 | | |

The invention claimed is:

1. A process for producing cadmium-free materials based on silver, comprising:

providing a first alloy comprising silver and at least one oxidizable alloying element, the first alloy being free from cadmium;

enlarging the surface area of the first alloy to give a second alloy;

performing a first heat treatment of the second alloy to give a third alloy, with the first heat treatment being carried out in a reducing atmosphere; and performing a second heat treatment of the third alloy to give a fourth alloy, with the second heat treatment being carried out in an oxygen-containing atmosphere, wherein the second heat treatment is an internal oxidation step which is carried out in two temperature stages, where the first stage is carried out at a first temperature of from 500° C. to 150° C. below the solidus temperature of the first alloy for a first period of time and the second stage is carried out at a temperature of from 500° C. to 5° C. below the solidus temperature of the first alloy for a second period of time, with the second temperature being 70-160° C. higher than the first temperature, and wherein the second heat treatment is carried out in an oxygen-containing atmosphere comprising elemental oxygen, nascent oxygen, ozone, or mixtures thereof at ambient pressure.

2. The process of claim 1, wherein the first heat treatment is carried out at a temperature of from 350° C. to 5° C. below the solidus temperature of the first alloy for a time of from 15 seconds to 3 hours.

3. The process of claim 1, wherein the first heat treatment is carried out in a reducing atmosphere comprising hydrogen, carbon monoxide, hydrocarbons, methane, nitrogen, a noble gas or mixtures thereof and in a stream of the reducing atmosphere at a pressure of less than 2 bar.

4. The process of claim 1, wherein the first period of time is from 30 to 240 minutes and the second period of time is from 10 hours to 7 days.

5. The process of claim 1, wherein the oxidizable alloying element of the first alloy is selected from the group consisting of indium, tellurium, bismuth, nickel, copper, zinc, tin, gallium, germanium, selenium, manganese, magnesium, aluminum, lead and combinations thereof.

6. The process of claim 1, wherein the first alloy comprises up to 8% by weight of tin or zinc, or from 8% by weight to 12% by weight of zinc, or from 8% by weight to 12% by weight of tin in combination with indium in amounts of from 2 to 15% by weight.

7. The process of claim 1, wherein the first alloy comprises from 0.05% by weight to 4% by weight of tellurium or bismuth.

8. The process of claim 1, wherein the fourth alloy contains more than 12% by weight of oxide.

9. The process of claim 1, wherein the fourth alloy cools after the second heat treatment.

10. The process of claim 1, wherein the fourth alloy is subjected to a third heat treatment to produce a fifth alloy.

11. The process of claim 10, wherein the third heat treatment is carried out from 900 to 970° C. for 2 to 40 hours.

12. The process of claim 11, wherein the third heat treatment is carried out for 10 to 20 hours.

13. The process of claim 10, wherein the fourth or fifth alloy is pressed, sintered and optionally formed by extrusion pressing.

* * * * *